United States Patent [19]

Haynes

[11] Patent Number: 4,651,434

[45] Date of Patent: Mar. 24, 1987

[54] CARPENTER'S TEMPLATE

[76] Inventor: William P. Haynes, 1700-A Foremaster La., Las Vegas, Nev. 89101

[21] Appl. No.: 855,692

[22] Filed: Apr. 25, 1986

[51] Int. Cl.[4] ..... B43L 13/20

[52] U.S. Cl. ..... 33/481; 33/562

[58] Field of Search ..... 33/481, 474, 403, 562, 33/476

[56] References Cited

U.S. PATENT DOCUMENTS

| | | | |
|---|---|---|---|
| 855,987 | 6/1907 | Schlageter | 33/47 X |
| 1,125,010 | 1/1915 | Doner | 33/481 |
| 1,135,259 | 4/1915 | Cokely | 33/481 |
| 2,204,927 | 6/1940 | Cramer | 33/481 |
| 2,713,203 | 7/1955 | Gottlieb | 33/494 X |
| 3,010,209 | 11/1961 | McKinley | 33/481 |

*Primary Examiner*—Harry N. Haroian

*Attorney, Agent, or Firm*—Edward J. Quirk

[57] ABSTRACT

A carpenter's template useful particularly for residential framing construction has an L-shaped crosssection formed by a faceplate having a width of about 4" and a flange having a width of about 1⅝". The faceplate has three series of slots for marking rafter cuts for common rafters, hip and valley rafters, and jack rafters, respectively. The flange is configured at its ends into angled edges useful for cheek cuts and dub cuts. The faceplate is marked with indicia related to roof pitch to permit the carpenter to select the appropriate slots.

9 Claims, 4 Drawing Figures

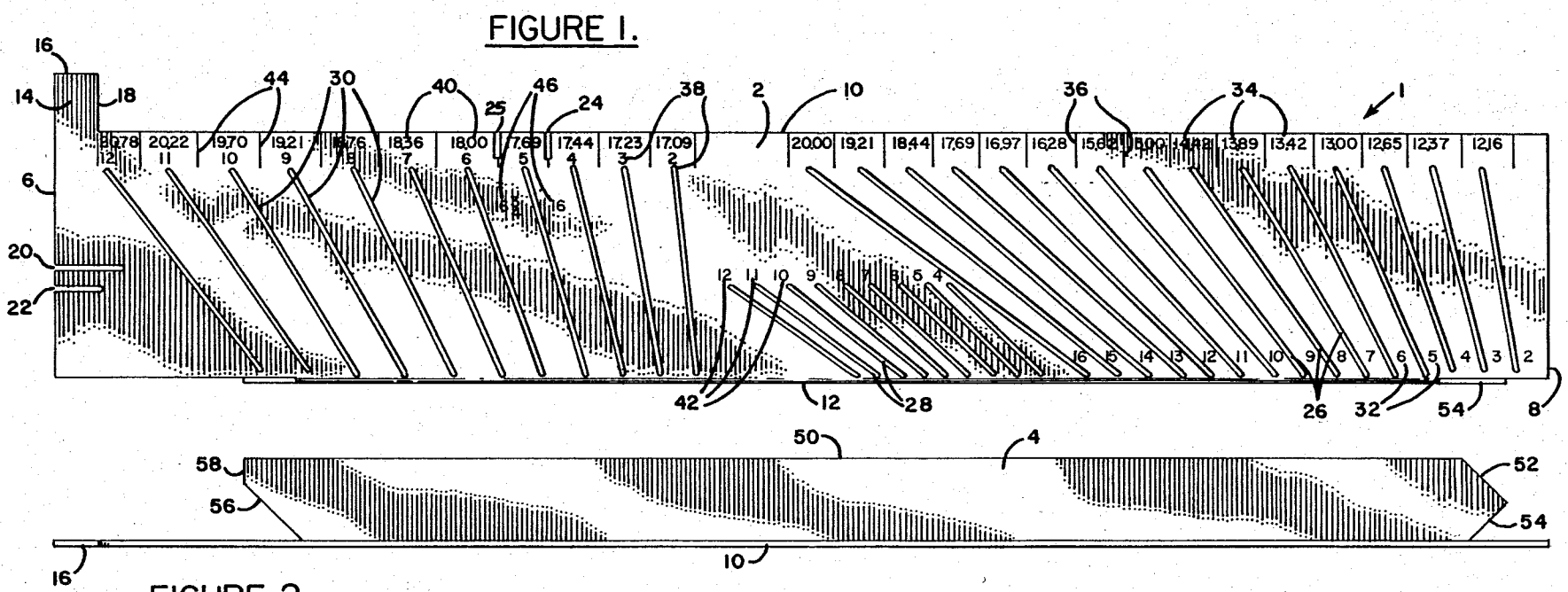
FIGURE 1.
FIGURE 2.
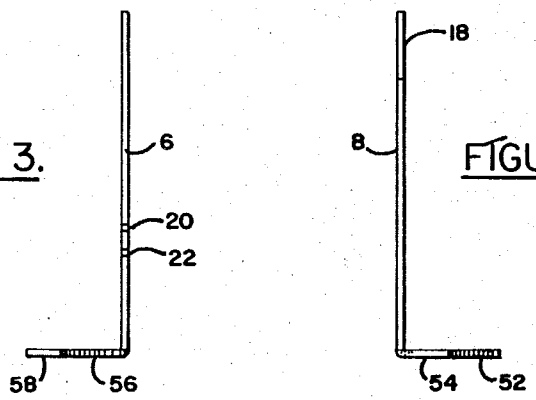
FIGURE 3.
FIGURE 4.

CARPENTER'S TEMPLATE

BACKGROUND OF THE INVENTION

This invention relates to templates designed specifically for marking cut lines for construction of roof rafters. In particular, the invention provides a single template which may be used to facilitate all rafter cuts necessary to be made in the construction of a sloping roof.

In the construction of a typical sloping roof, a number of specific cuts must be made in various sizes of boards in order to construct the frame of the roof. The types of cuts which need to be made will depend upon the height and width of the building, the pitch of the roof, and the dimensions of the various structural elements such as the ridgeboard, plates, and rafters. In general, a horizontal ridgeboard is positioned centrally at the upper portion of the roof, and is supported by various elevated boards or rafters above a horizontal "top plate" which extends around the periphery of the roof. The top plates are generally supported by vertical studs which extend upwardly from a bottom plate. Depending on the roof design, the cutting of rectangular boards to fit properly at all locations on the roof is an art which may require many complex cuts at various oblique angles on the wood. In order for the roof to be constructed properly, it is essential that the various components have surfaces which meet in a flush manner.

The laying out of roof truss members is often a time consuming job requiring error-free computations and measurements, and frequently involves trial and error fittings which must be done more than once. The present invention provides a template which can be used as a guide to draw cut lines along various truss members, and eliminates trial and error on all truss cuts. Accordingly, the object of the present invention is to provide a template or guide which may be used to define accurate cutting surfaces for roof trusses. It is a further object of the invention to minimize the number of calculations necessary to determine the proper angle of cuts for such members. It is yet a further object of the invention to provide a single template which may be used for substantially all rafter cuts. These and other objects are accomplished by the use of the tool of the invention, a detailed description of which is contained herein.

Other carpenter's templates have been used for the purpose of assisting in laying out of roof trusses. Doner, U.S. Pat. No. 1,125,010 discloses a simple tool having various guide slots for common rafters and jack rafters. Haley, U.S. Pat. No. 2,965,969 shows a similar tool having a single slot and a triangular cut-out for marking a heel cut in a rafter. This tool is also used for making ridge cuts and tail cuts. Shaw, U.S. Pat. No. 3,183,596, and McKinley, U.S. Pat. No. 3,010,209 disclose various templates for rafter marking which are used in sets depending upon the particular angles necessary.

BRIEF SUMMARY OF THE INVENTION

A carpenter's template has a flat, generally rectangular faceplate and a flange portion which depends perpendicularly from a longitudinal edge of the faceplate. The flange is relatively narrow and has a point formed by two perpendicular edges at one end, and an edge extending outwardly approximately 45° from the faceplate edge at the other end. The faceplate has a first series of slots for marking cuts on common rafters, a second series of slots for marking cuts for hip and valley rafters, and a third set of slots for marking side cuts for jack rafters. Each slot is marked with a number identifying the slot by roof pitch; i.e., rise/foot of run. A tooth extending upwardly along one edge of the tool, and at least one longitudinal slot extending inwardly form said edge, are used for various other rafter cut measurements.

BRIEF DESCRIPTION OF THE DRAWINGS

The invention is best understood with reference to the drawings, in which:

FIG. 1 is a front plan view of the template of the invention;

FIG. 2 is a view of the template from the top thereof;

FIG. 3 is an end view of the template shown in FIG. 1; and

FIG. 4 is an end view of the opposite end of the template from the one shown in FIG. 3.

DETAILED DESCRIPTION OF A PREFERRED EMBODIMENT

Referring first to FIG. 1, the template 1 comprises a planar faceplate 2 and a longitudinal "angle" or flange 4 which extends perpendicularly from a longitudinal edge of the faceplate. The faceplate is formed peripherally in part by a pair of longitudinal parallel edges 10 and 12, and a pair of lateral parallel edges 6 and 8. The faceplate has a width of 4", and a length of about 24". A tooth or lug 14 extends laterally from the left end of the faceplate; the tooth has an inner edge 18 having a length of 1", and an upper edge 16 having a width of ¾". Including the tooth extension, lateral edge 6 has a length of five inches, and is used for measuring cuts for the corner hip rafter at each corner of the top plate.

A slot 20 extending inwardly longitudinally and perpendicularly from edge 6 is located 3⅛" from the upper edge 16 of the tooth 14 and is used optionally to make cuts for jack rafters. A second longitudinal slot 22 located 3½" below the top edge 16 of tooth 14 is used to mark a ¾" line which is used to measure the seat mark for all common rafters. A transverse slot 24 which extends inwardly from the top edge 10 of the faceplate is located 8" from the left of edge 6 of the faceplate and is used for the purpose of making a bird's mouth seat cut; it is also 16" from the right edge of the faceplate and is used along with slot 25, to measure stud separation for 16" studs.

Three separate and distinct sets of grooves or slots are cut in the face of the template. A first set of fifteen slots 26, each of which is of a slightly different angle to horizontal, is used for making common rafter cuts. A second set of nine slots 28, which are about 2½ in length, are located in a central portion of the faceplate and are used for making side-cut marks for jack rafters. A third set of eleven slots 30 at a left portion of the faceplate are used for marking cuts for hip and valley rafters.

Each of the slots on the faceplate is marked with an integer which indexes the slot to a particular roof pitch. The fifteen common rafter slots 26 are marked with integers 32 sequentially from two to sixteen. Similarly, the centrally located jack rafter slots are marked with numbers 42 sequentially from four to twelve, and the hip and valley rafter slots are marked with integers 38 extending sequentially from two to twelve. These numbers identify the pitch of the roof being measured, and are equal to the rise (in inches) per foot of run for the roof. In a building having a pitched roof, the "rise" is the height (in inches), and the "run" is the length (in feet) of a right triangle of which the roof surface forms the hypotenuse. For example, if a building is 24' wide, and is 2' higher at the peak than at the edge, the "run" is equal to 12' and the rise is 24"; the "rise per foot of run" is 2". Alternatively, these dimensions may be referred to as a "2 in 12 pitch", indicating a rise of 2" for every 12" of horizontal distance. The pitch of the roof is of course determined by architect's plans; therefore, the particular slots used on the template are predetermined by the roof design.

Above the common rafter slots at the right portion of the template and the hip and valley rafter slots at the left portion of the template are a series of four-digit numbers 34 and 40, respectively. These numbers are separated by a series of parallel transverse guide markings 36 and 44 to enable easy visual correlation of the four-digit number with the slot. The four digit number specifies the length of the rafter to be cut (in inches) for every foot of run. For example, if the rise per foot run is 8", the length of a common rafter per foot of run is 14.42". If the run were 20', the length of a common rafter would be 20×14.42, or 288.4" (24.3'). The use of the four-digit numbers at the top of the hip and valley rafter slots 30 is the same as for the common rafter slots.

The flange 4, which is best seen in FIGS. 2, 3, and 4, is a flat, planar member which extends perpendicularly from the faceplate. The flange has a width of 1½", and has two parallel opposing longitudinal edges 12 and 50. One end of the flange is cut to a point formed by perpendicular edges 52 and 54. These two edges, which are equal in length, are used for marking hip and valley rafter cheek cuts. Usually, a hip or valley rafter terminates at the ridgeboard between two common rafters at a 45° angle.

The opposing end of the flange is used to mark a "dub cut". This end of the flange, which is best seen in FIGS. 2 and 3, has a short edge 58 extending inwardly and perpendicularly from longitudinally from longitudinal edge 50 of the flange, and an inwardly extending edge 56 which forms a 45° angle with longitudinal edge 12. A dub cut is used to make a seat, or "bird's mouth", in a hip rafter to permit it to fit over the sharp corner of a building.

Slots 24 and 25 are marks 16" and 16¾" respectively, from the right edge of the faceplate; the distances are marked on the faceplate as shown at 46. These marks are used to measure the stud separations for 16"-center studs. When the bottom plate is cut to attach studs, a first mark is made 16¾" from the end of the plate and represents the center mark for the first stud. Marks are repeatedly made thereafter along the bottom plate at 16" intervals to provide the stud center marks.

The various cuts, and the manner in which they are made, are described in detail in Reed, *Residential Carpentry,* John Wiley and Sons, 1980. The manner in which the tool of the invention is used to make these cuts is as follows. Assume that a building is designed with a 24' width and a "6 in 12" roof pitch. The "run" is 12', and the rise/foot of run is 6". The template is placed over the broad side of a 2×4 with the crown side of the 2×4 toward the carpenter, and the angle portion of the tool abutting the crown with the point on the angle pointing to the right. The tool is moved to the right portion of the 2×4, to within a few inches of the end. The carpenter places a pencil in the #6 slot and marks across the 2×4. This provides a mark for the angle cut at the ridgeboard, which is known as the "ridgeboard plumb mark". The tool is removed ad the board is cut along this mark. Next, the length of the rafter is calculated from the scale at the end of the #6 slot. The length of the rafter is 13.42 inches per foot of run, or, for a building having a 12' run, 13'5". To determine an accurate length, a carpenter will deduct ½ of the width of the ridgeboard (generally ⅜") and will mark the board perpendicularly across its surface at 13' 4⅝". The template is then placed in the same orientation so that the #6 slot is over the mark made to determine the length of the rafter, with the bottom of the slot over the mark, and another mark is drawn using the #6 slot. This is the seat plumb mark. Next, the end edge 6 is placed over the plumb mark that was just made, with the corner of the lug 14 formed by edges 6 and 16 at the point where the mark meets the edge (opposite the crown edge) of the rafter. Another mark 3½" long is made perpendicular to the plumb mark. This is the seat mark to form the "bird's mouth", or triangle that fits over the top plate of the building. If an overhang has been designed, the overhang is measured on the end of the rafter and another plumb line is made using the #6 slot. At this point, the rafter is entirely marked and ready to be cut. Experience has shown that common rafters can be cut approximately 5 times faster using the template of the invention than when a carpenter's square is used.

The hip and valley rafter slots 30 are used in exactly the same manner as the common rafter slots. These rafters are less steep than common rafters since a 6" rise is obtained for 17" of run, rather than 12" as is the case with common rafters.

The nine short slots 28 in the center portion of the tool are used to make side cuts on jack rafters (i.e., rafters extending from the top plate to a hip rafter). These cuts are made across the narrow edge of a 2×4. The 2×4 is laid on edge, and the tool is placed with the faceplate abutting the edge of the board and the angle abutting the width of the board. The tool is placed near one end of the board, with the slots 28 extending toward the length of the board, and the edge is marked by using the appropriate slot (e.g., at #6 slot for a 6 in 12 pitch). A "cheek cut" is made along this line. Next, the 2×4 is placed on its wide face with the cheek cut away from the carpenter, and the template is placed on the board with the flange abutting the bottom edge, and a plumb cut is mark using the same slot as for common rafters, e.g., a #6 slot for a 6 in 12 pitch roof.

Collar beams, which are horizontal braces, and gable studs, which extend from the top plate to a common rafter, can also be marked by using the #6 common rafter slot.

While the invention has been shown with respect to a specific embodiment thereof, it will be readily apparent to one skilled in the art that some modification may be made thereto within the spirit and scope of the invention. Accordingly, the invention should be limited not by the description of the specific embodiment, but rather should be limited only by the following claims.

I claim:

1. A carpenter's template comprises an elongate member having an L-shaped cross section, said member being comprised of a planar, generally rectangular faceplate having generally straight upper and lower edges and opposing straight parallel side edges, and a rectangular tooth member extending outwardly about 1" from the top edge of the faceplate wherein one edge of the tooth member is a straight extension of a side edge of the faceplate, and a flange depending perpendicularly from a longitudinal edge of the faceplate, the flange having a pointed end portion formed by two perpendicular edges, a first series of slots in the faceplate for marking cuts for common rafters, a second series of slots in the faceplate for marking cuts for hip and valley rafters, a third set of slots for marking side cuts for jack rafters, and indicia marked on the faceplate for identifying slope characteristics of each slot.

2. The template of claim 1 wherein the tooth member has a length of about 1" and a width of about ¼".

3. The template of claim 1 also comprising a longitudinal slot extending inwardly from a side edge of the faceplate.

4. The template of claim 1 wherein the slot is perpendicular to a side edge of the faceplate.

5. The template of claim 1 also comprising a slot extending inwardly and perpendicularly from a longitudinal edge of the faceplate, said slot being located substantially 16" from a lateral edge of the faceplate.

6. The template of claim 5 also comprising a second slot extending inwardly and perpendicularly from the same longitudinal edge, said slot being located substantially 16¼" from a lateral edge of the faceplate.

7. The template of claim 1 wherein each series of slots comprises at least six separate slots.

8. The template of claim 1 wherein the third set of slots are substantially shorter than the first and second set of slots.

9. The template of claim 1 wherein the flange has a substantially uniform width and having a second end portion opposing the pointed end portion having an edge extending outwardly at a substantially 45° angle from the longitudinal edge of the faceplate.

* * * * *